US011950630B2

(12) United States Patent
Jones

(10) Patent No.: US 11,950,630 B2
(45) Date of Patent: Apr. 9, 2024

(54) PILLOWCASE VAPORIZING ASSEMBLY

(71) Applicant: Reginald Jones, Aurora, CO (US)

(72) Inventor: Reginald Jones, Aurora, CO (US)

( * ) Notice: Subject to any disclaimer, the term of this patent is extended or adjusted under 35 U.S.C. 154(b) by 556 days.

(21) Appl. No.: 17/154,115

(22) Filed: Jan. 21, 2021

(65) Prior Publication Data

US 2022/0225673 A1 Jul. 21, 2022

(51) Int. Cl.
*A24F 40/42* (2020.01)
*A24F 40/10* (2020.01)
*A47G 9/10* (2006.01)

(52) U.S. Cl.
CPC ..... *A24F 40/42* (2020.01); *A24F 40/10* (2020.01); *A47G 9/1045* (2013.01)

(58) Field of Classification Search
CPC ..... A24F 40/00; A24F 40/10; A24F 40/42; A47G 9/007; A47G 9/0253; A47G 9/1045
See application file for complete search history.

(56) References Cited

U.S. PATENT DOCUMENTS 4,688,286 A * 8/1987 Miker, Jr. ..... A45C 15/00 5/639
8,850,643 B2 * 10/2014 White ..... A47G 9/1045 5/636
9,009,889 B1 * 4/2015 Cohen ..... A47G 9/0253 5/490
D728,271 S 5/2015 Cohen
9,640,167 B2 * 5/2017 DeFranks ..... G10K 11/17881
10,201,630 B2 * 2/2019 Antonino ..... A61M 21/02
11,006,719 B1 * 5/2021 Wilde ..... A24F 40/40
11,191,374 B1 * 12/2021 Johnson ..... A47G 9/0223
2007/0090135 A1 * 4/2007 Benham ..... A45F 3/20 224/148.2
2010/0024130 A1 * 2/2010 Moore ..... A47G 9/0253 5/636
2013/0214001 A1 * 8/2013 Katz ..... A45F 3/20 222/105
2016/0058074 A1 * 3/2016 Liu ..... A24F 40/50 131/329
2017/0172236 A1 * 6/2017 Shakir-Ferguson ... A41B 13/10
2019/0191895 A1 * 6/2019 Shek ..... A47G 9/007
2020/0000253 A1 * 1/2020 Mell ..... A47G 9/0253

* cited by examiner

*Primary Examiner* — Abdullah A Riyami
*Assistant Examiner* — Thang H Nguyen

(57) ABSTRACT

A pillowcase vaporizing assembly includes a pillowcase that has an open end to receive a pillow for sleeping. A pouch is provided that has an entry extending into an interior of the pouch and the pouch is insertable into the open end of the pillowcase. A pocket is integrated into the pouch and the pocket is positioned within the pouch. A vaporizer is slidable into the pocket in the pouch and the vaporizer has an output for releasing an inhalable vapor. A hose is fluidly attachable to the output of the vaporizer such that the tube receives the inhalable vapor from the vaporizer. A mouthpiece is fluidly attachable to the hose and the mouthpiece can be placed in the user's mouth thereby facilitating the user to inhale the inhalable vapor.

11 Claims, 5 Drawing Sheets

PILLOWCASE VAPORIZING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to vaporizing devices and more particularly pertains to a new vaporizing device for facilitating a user to enjoy a vaporizer while lying in bed. The vaporizing device includes a pouch that can be attached inside a pillowcase and a pocket integrated into the pouch for storing an electronic vaporizer. In this way a user can inhale vapor produced by the electronic vaporizer while the user is lying in bed.

(2) Description of Related Art Including Information Disclosed Under 37 CFR 1.97 and 1.98

The prior art relates to vaporizing devices including a pillow that has an air effusion unit integrated therein for urging air outwardly from the pillow. Additionally, the prior art discloses a pillow that has an aromatherapy unit integrated therein and a binaural unit integrated therein. The prior art also discloses a variety of pillowcases that have a pouch that is removably integrated into the pillowcase.

BRIEF SUMMARY OF THE INVENTION

An embodiment of the disclosure meets the needs presented above by generally comprising a pillowcase that has an open end to receive a pillow for sleeping. A pouch is provided that has an entry extending into an interior of the pouch and the pouch is insertable into the open end of the pillowcase. A pocket is integrated into the pouch and the pocket is positioned within the pouch. A vaporizer is slidable into the pocket in the pouch and the vaporizer has an output for releasing an inhalable vapor. A hose is fluidly attachable to the output of the vaporizer such that the tube receives the inhalable vapor from the vaporizer. A mouthpiece is fluidly attachable to the hose and the mouthpiece can be placed in the user's mouth thereby facilitating the user to inhale the inhalable vapor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
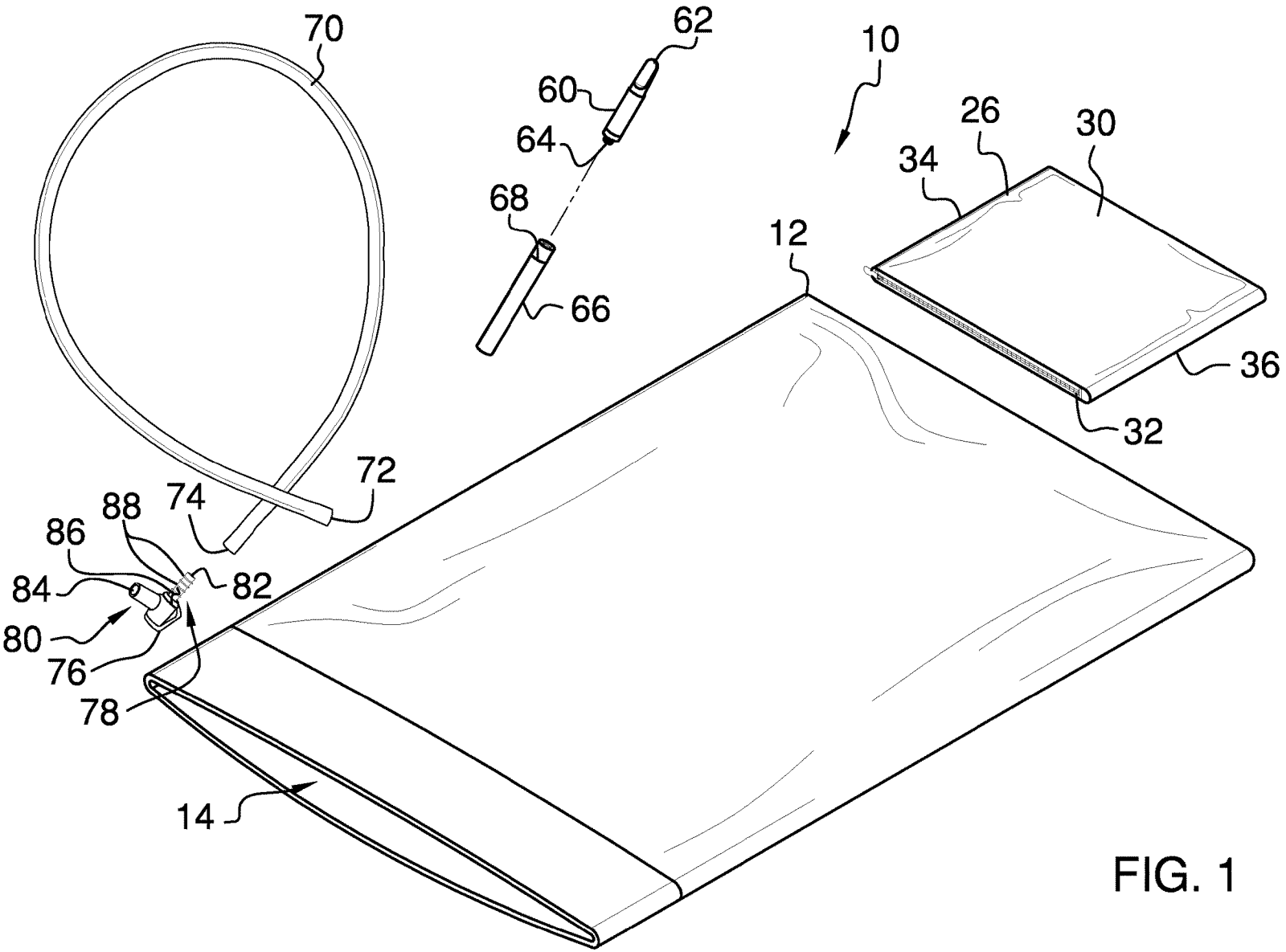
FIG. 1 is a perspective view of a pillowcase vaporizing assembly according to an embodiment of the disclosure.
Figure 2:
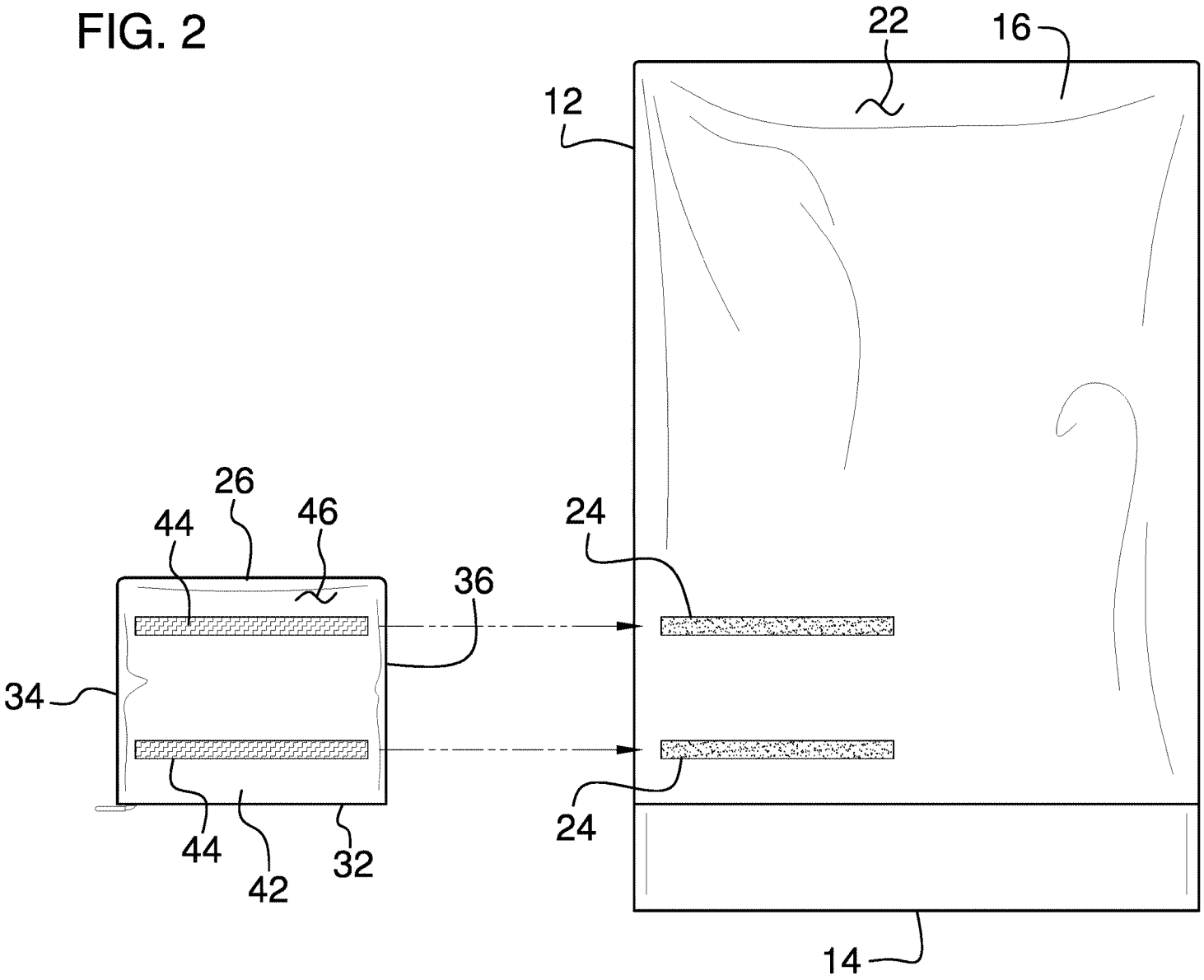
FIG. 2 is an exploded perspective view of an embodiment of the disclosure showing a pillowcase being turned inside out.
Figure 3:
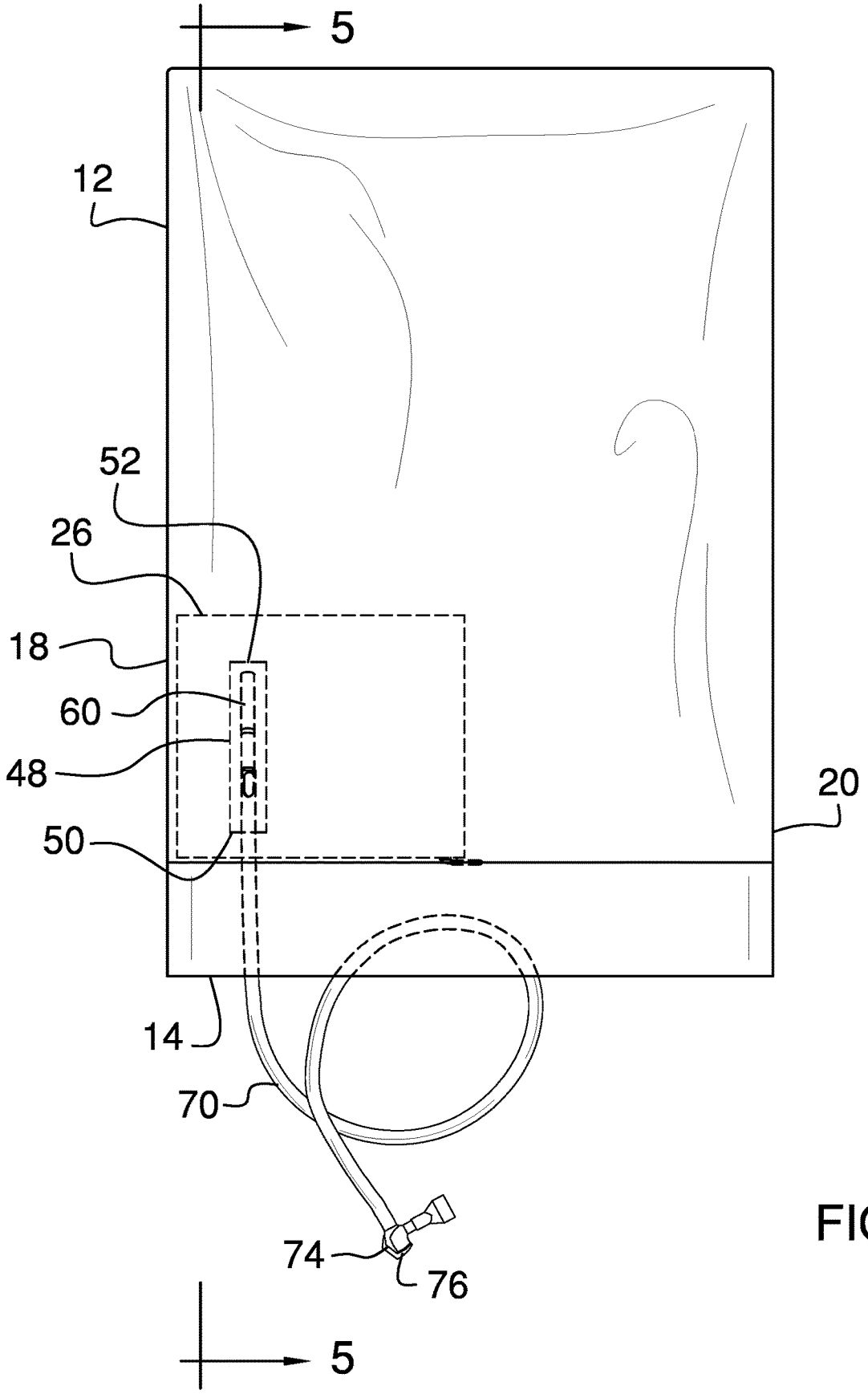
FIG. 3 is a top phantom view of an embodiment of the disclosure.
Figure 4:
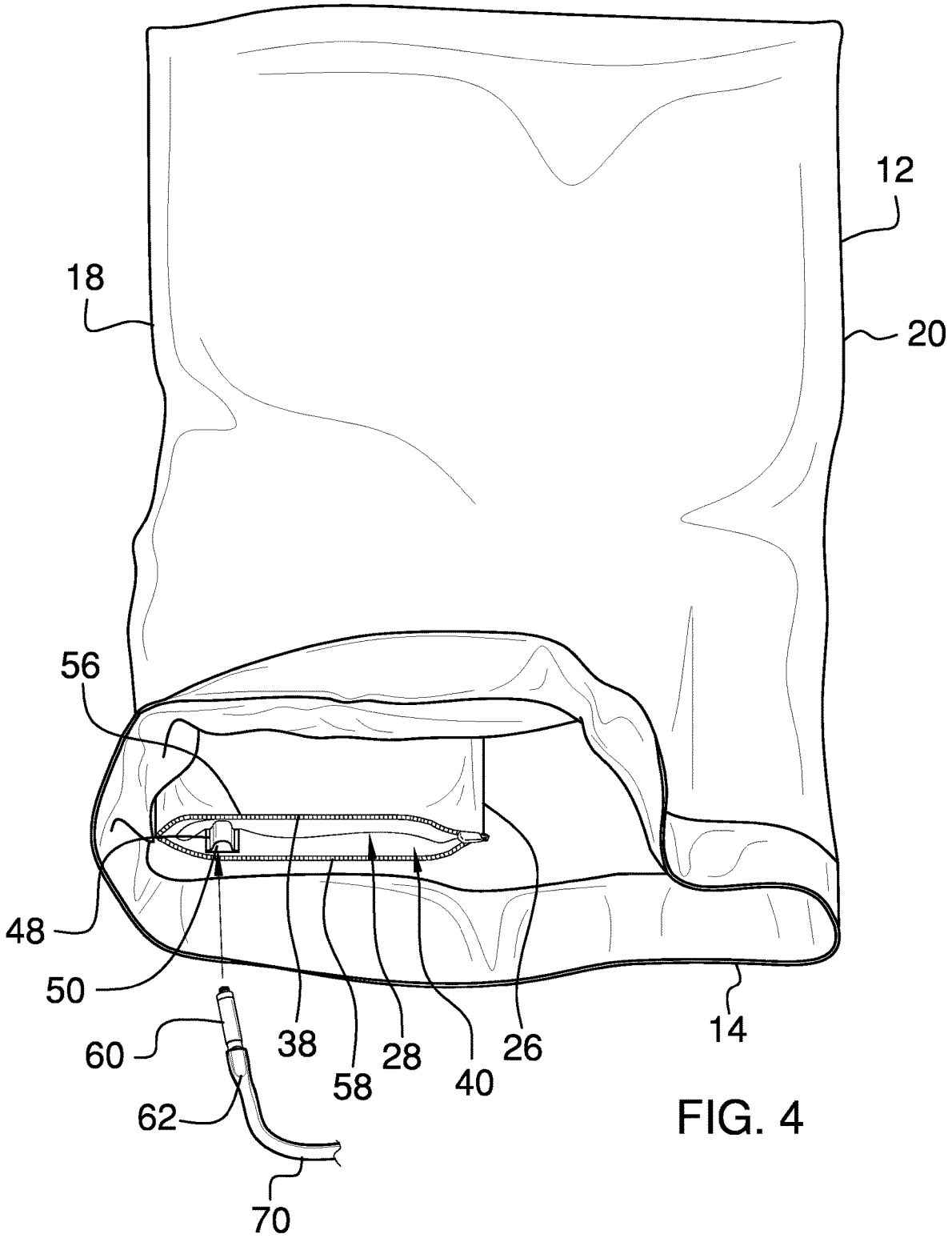
FIG. 4 is a perspective in-use view of an embodiment of the disclosure.
Figure 5:
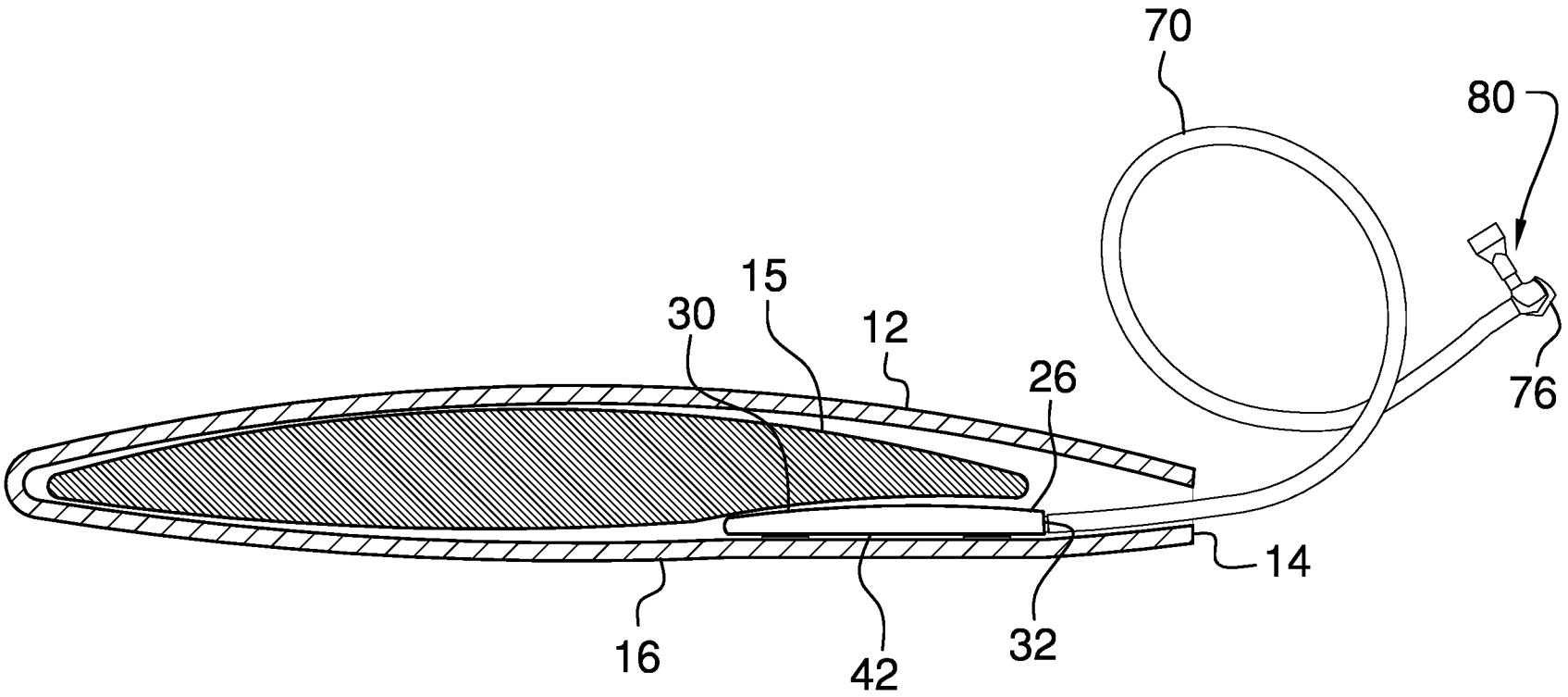
FIG. 5 is a cross sectional view taken along line 5-5 of FIG. 3 of an embodiment of the disclosure.

With reference now to the drawings, and in particular to FIGS. 1 through 5 thereof, a new vaporizing device embodying the principles and concepts of an embodiment of the disclosure and generally designated by the reference numeral 10 will be described.

As best illustrated in FIGS. 1 through 5, the pillowcase vaporizing assembly 10 generally comprises a pillowcase 12 that has an open end 14 to receive a pillow 15 for sleeping. The pillowcase 12 has a bottom side 16, a first lateral edge 18 and a second lateral edge 20. The bottom side 16 has an inside surface 22 and the open end 14 is open into an interior of the pillowcase 12. The pillowcase 12 may be a pillowcase of any conventional design and size and the pillow 15 inserted into the pillowcase 12 may be a sleeping pillow of any conventional design and size.

A pair of first mating members 24 is each coupled to the inside surface 22 of the bottom side 16. Each of the first mating members 24 is positioned adjacent to the open end 14 of the pillowcase 12. Moreover, the first mating members 24 are oriented to extend substantially between the first lateral edge 18 and the second lateral edge 20. Each of the first mating members 24 may comprise a hook and loop fastener or other type of releasable, multiple use fastener.

A pouch 26 is provided that has an entry 28 extending into an interior of the pouch 26. The pouch 26 is insertable into the open end 14 of the pillowcase 12 and the pouch 26 is releasably matable to the pillowcase 12 to inhibit the pouch 26 from travelling in the pillowcase 12. The pouch 26 has an outer wall 30, a front side 32, a first sidelong edge 34 and a second sidelong edge 36. The entry 28 extends through the front side 32 and the entry 28 extends along a full length of the front side 32. Additionally, the entry 28 has a first bounding edge 38 and a second bounding edge 40, and the outer wall 30 has a top side 42.

A pair of second mating members 44 is each coupled to an outer surface 46 of the top side 42 of the outer wall 30 of the pouch 26. Each of the second mating members 44 is oriented to extend substantially between the first sidelong side 34 and the second sidelong edge 36 of the pouch 26. The second mating members 44 are spaced apart from each other and each of the second mating members 44 releasably engages a respective one of the first mating members 24. Moreover, the front side 32 of the pouch 26 is aligned with the open end 14 of the pillowcase 12 such that the entry 28 in the pouch 26 is accessible to a user.

A pocket 48 is provided, the pocket 48 is integrated into the pouch 26 and the pocket 48 is positioned within the pouch 26. The pocket 48 has a first end 50 and a second end 52, and the pocket 48 is elongated between the first end 50 and the second end 52. Moreover, the first end 50 is open into an interior of the pocket 48 and the second end 52 is closed. The pocket 48 is positioned on an interior surface 54 of the outer wall 30 of the pouch 26 and the first end 50 is positioned adjacent to the entry 28 in the pouch 26. Moreover, the pocket 48 is oriented such that a line extending through the first end 50 and the second end 52 is oriented parallel to the first lateral edge 18 of the pillowcase 12 when the pouch 26 is positioned in the pillowcase 12.

A first fastener 56 is coupled to the first bounding edge 38 of the entry 28 in the pouch 26 and the first fastener 56 extends along a full length of the first bounding edge 38. A second fastener 58 is coupled to the second bounding edge 40 of the entry 28 in the pouch 26 and the second fastener 58 extends along a full length of the second bounding edge 40. The second fastener 58 is releasably matable to the first fastener 56 for opening and closing the entry 28. The first fastener 56 and the second fastener 58 may comprise complementary halves of a zipper or other type of releasable, mechanical fastener.

A vaporizer 60 is provided and the vaporizer 60 is slidable into the pocket 48 in the pouch 26. The vaporizer 60 has an output 62 for releasing an inhalable vapor. The vaporizer 60 is insertable into the first end 50 of the pocket 48 having the output 62 being exposed with respect to the first end 50 of the pocket 48 such that the output 62 is accessible to the user. The vaporizer 60 includes a heating element 64 and a fluid cartridge 66. The heating element 64 heats a fluid 68 contained within the fluid cartridge 66 thereby facilitating the heating element 64 to vaporize the fluid 68 into the inhalable vapor which passes through the output 62. The vaporizer 60 may comprise an electronic vaporizer of any conventional design and the fluid in the cartridge 66 may comprise a nicotine solution of other solution that is commonly employed in vaporizers for inhalation. Additionally, replacement fluid cartridges for the vaporizer 60, a charger for the vaporizer 60 and other objects can be stored in the pouch 26.

A hose 70 is provided and the hose 70 is fluidly attachable to the output 62 of the vaporizer 60 such that the hose 70 receives the inhalable vapor from the vaporizer 60. The hose 70 has a primary end 72 and a secondary end 74, and the primary end 72 is fluidly attachable to the output 62 of the vaporizer 60 such that the hose 70 is extendable outwardly from the pillowcase 12. Additionally, the hose 70 is positionable within the pouch 26 for storage. A mouthpiece 76 is fluidly attachable to the hose 70 such that the mouthpiece 76 receives the inhalable vapor from the vaporizer 60. Thus, the mouthpiece 76 can be placed in the user's mouth thereby facilitating the user to inhale the inhalable vapor.

The mouthpiece 76 has a first portion 78 forming an angle with a second portion 80, the first portion 78 has a distal end 82 with respect to the second portion 80, and the second portion 80 has a distal end 84 with respect to the first portion 78. The first portion 78 has an outer surface 86 and the outer surface 86 has a plurality of ridges 88 each extending outwardly from the outer surface 86. Each of the ridges 88 extends around a full circumference of the first portion 78, and the ridges 88 are spaced apart from each other and are distributed along a full length of the first portion 78. The first portion 78 is insertable into the secondary end 74 of the hose 70 such that the plurality of ridges 88 frictionally engages an inside surface 22 of the hose 70 for retaining the first portion 78 in the hose 70. The mouthpiece 76 may include a valve that facilitates air to flow outwardly from the second portion 80 but inhibits air from flowing inwardly on the second portion 80.

In use, the vaporizer 60 is inserted into the pouch 26 and the secondary end 74 of the hose 70 is fluidly coupled to the output 62. The pouch 26 is positioned in the pillowcase 12 such that the first mating members 24 engage the second mating members 44. In this way the hose 70 can be pulled outwardly from the pillowcase 12 thereby facilitating the user to inhale through the mouthpiece 76. In this way the user can enjoy inhaling the inhalable vapor while the user is lying in bed. Additionally, the vaporizer 60 can be stored in the pouch 26 instead of storing the vaporizer 60 on a nightstand as is commonly required thereby enhancing convenience for the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pillowcase vaporizing assembly for storing a vaporizer in a pillowcase thereby facilitating a user to employ a vaporizer while lying in bed, said assembly comprising:

a pillowcase having an open end wherein said open end is configured to receive a pillow for sleeping;

a pouch having an entry extending into an interior of said pouch, said pouch being insertable into said open end of said pillowcase, said pouch being releasably matable to said pillowcase to inhibit said pouch from travelling in said pillowcase;

a pocket being integrated into said pouch, said pocket being positioned within said pouch;

a vaporizer being slidable into said pocket in said pouch, said vaporizer having an output for releasing an inhalable vapor;

a hose being fluidly attachable to said output of said vaporizer such at said hose receives the inhalable vapor from said vaporizer;

a mouthpiece being fluidly attachable to said hose such that said mouthpiece receives the inhalable vapor from said vaporizer wherein said mouthpiece is configured to be placed in the user's mouth thereby facilitating the user to inhale the inhalable vapor;

wherein said pouch has an outer wall, a front side, a first sidelong edge and a second sidelong edge, said entry extending through said front side, said entry extending along a full length of said front side, said entry having a first bounding edge and a second bounding edge, said outer wall having a top side; and wherein said pocket has a first end and a second end, said pocket being elongated between said first end and said second end, said first being open into an interior of said pocket, said second end being closed, said pocket being positioned on an interior surface of said outer wall of said pouch, said first end being positioned adjacent to said entry in said pouch, said pocket being oriented such that a line extending through said first end and said second is oriented parallel to a first lateral edge of said pillowcase when said pouch is positioned in said pillowcase.

2. The assembly according to claim 1, wherein:

said pillowcase has a bottom side, a first lateral edge and a second lateral edge, said bottom side having an inside surface, said open end being open into an interior of said pillowcase; and said assembly includes a pair of first mating members, each of said first mating members being coupled to said inside surface of said bottom side, each of said first mating members being positioned adjacent to said open end of said pillowcase, said first mating members being oriented to extend substantially between said first lateral edge and said second lateral edge.

3. The assembly according to claim 1, further comprising:

a pair of first mating members, each of said first mating members being coupled to said pillowcase, each of said first mating members being positioned adjacent to said open end of said pillowcase; and a pair of second mating members, each of said second mating members being coupled to an outer surface of said top side of said outer wall of said pouch, each of said second mating members being oriented to extending substantially between said first sidelong side and said second sidelong side, said second mating members being spaced apart from each other, each of said second mating members releasably engaging a respective one of said first mating members such that said front side is aligned with said open end of said pillowcase wherein said entry in said pouch is configured to be accessible to a user.

4. The assembly according to claim 1, further comprising a first fastener being coupled to said first bounding edge of said entry in said pouch, said first fastener extending along a full length of said first bounding edge.

5. The assembly according to claim 4, further comprising a second fastener being coupled to said second bounding edge of said entry in said pouch, said second fastener extending along a full length of said second bounding edge, said second fastener being releasably rentable to said first fastener for opening and closing said entry.

6. The assembly according to claim 1, wherein said vaporizer is insertable into said first end of said pocket having said output being exposed with respect to said first end of said pocket wherein said output is configured to be accessible to the user, said vaporizer including a heating element and a fluid cartridge, said heating element heating a fluid contained within said fluid cartridge thereby facilitating said heating element to vaporize the fluid into the inhalable vapor which passes through said output.

7. The assembly according to claim 6, wherein said hose has a primary end and a secondary end, said primary end being fluidly attachable to said output of said vaporizer such that said hose is extendable outwardly from said pillowcase, said hose being positionable within said pouch for storage.

8. The assembly according to claim 7, wherein said mouthpiece has a first portion forming an angle with a second portion, said first portion having a distal end with respect to said second portion, said second portion having a distal end with respect to said first portion, said distal end of said first portion being insertable into said secondary end of said hose.

9. The assembly according to claim 8, wherein said first portion has an outer surface, said outer surface having a plurality of ridges each extending outwardly from said outer surface, each of said ridges extending around a full circumference of said first portion, said ridges being spaced apart from each other and being distributed along a full length of said first portion, said first portion being insertable into said secondary end of said hose such that said plurality of ridges frictionally engages an inside surface of said hose for retaining said first portion in said hose.

10. A pillowcase vaporizing assembly for storing a vaporizer in a pillowcase thereby facilitating a user to employ a vaporizer while lying in bed, said assembly comprising:

a pillowcase having an open end wherein said open end is configured to receive a pillow for sleeping, said pillowcase having a bottom side, a first lateral edge and a second lateral edge, said bottom side having an inside surface, said open end being open into an interior of said pillowcase;

a pair of first mating members, each of said first mating members being coupled to said inside surface of said bottom side, each of said first mating members being positioned adjacent to said open end of said pillowcase, said first mating members being oriented to extend substantially between said first lateral edge and said second lateral edge;

a pouch having an entry extending into an interior of said pouch, said pouch being insertable into said open end of said pillowcase, said pouch being releasably matable to said pillowcase to inhibit said pouch from travelling in said pillowcase, said pouch having an outer wall, a front side, a first sidelong edge and a second sidelong edge, said entry extending through said front side, said entry extending along a full length of said front side, said entry having a first bounding edge and a second bounding edge, said outer wall having a top side;

a pair of second mating members, each of said second mating members being coupled to an outer surface of said top side of said outer wall of said pouch, each of said second mating members being oriented to extending substantially between said first sidelong side and said second sidelong side of said pouch, said second mating members being spaced apart from each other, each of said second mating members releasably engaging a respective one of said first mating members such that said front side is aligned with said open end of said pillowcase wherein said entry in said pouch is configured to be accessible to a user;

a pocket being integrated into said pouch, said pocket being positioned within said pouch, said pocket having a first end and a second end, said pocket being elongated between said first end and said second end, said first being open into an interior of said pocket, said second end being closed, said pocket being positioned on an interior surface of said outer wall of said pouch, said first end being positioned adjacent to said entry in said pouch, said pocket being oriented such that a line extending through said first end and said second is oriented parallel to said first lateral edge of said pillowcase when said pouch is positioned in said pillowcase;

a first fastener being coupled to said first bounding edge of said entry in said pouch, said first fastener extending along a full length of said first bounding edge;

a second fastener being coupled to said second bounding edge of said entry in said pouch, said second fastener extending along a full length of said second bounding edge, said second fastener being releasably matable to said first fastener for opening and closing said entry;

a vaporizer being slidable into said pocket in said pouch, said vaporizer having an output for releasing an inhalable vapor, said vaporizer being insertable into said first end of said pocket having said output being exposed with respect to said first end of said pocket wherein said output is configured to be accessible to the user, said vaporizer including a heating element and a fluid cartridge, said heating element heating a fluid contained within said fluid cartridge thereby facilitating said heating element to vaporize the fluid into the inhalable vapor which passes through said output;

a hose being fluidly attachable to said output of said vaporizer such that said tube receives the inhalable vapor from said vaporizer, said hose having a primary end and a secondary end, said primary end being fluidly attachable to said output of said vaporizer such that said hose is extendable outwardly from said pillowcase, said hose being positionable within said pouch for storage; and a mouthpiece being fluidly attachable to said hose such that said mouthpiece receives the inhalable vapor from said vaporizer wherein said mouthpiece is configured to be placed in the user's mouth thereby facilitating the user to inhale the inhalable vapor, said mouthpiece having a first portion forming an angle with a second portion, said first portion having a distal end with respect to said second portion, said second portion having a distal end with respect to said first portion, said first portion having an outer surface, said outer surface having a plurality of ridges each extending outwardly from said outer surface, each of said ridges extending around a full circumference of said first portion, said ridges being spaced apart from each other and being distributed along a full length of said first portion, said first portion being insertable into said secondary end of said hose such that said plurality of ridges frictionally engages an inside surface of said hose for retaining said first portion in said hose.

11. A method of employing an electronic vaporizer while a user is lying in bed, the steps of the method comprising:

providing pillowcase having an open end and an inner surface;

providing a pair of first mating members;

attaching each of said first mating members to said inner surface of said pillowcase;

providing a pouch having an entry, an inside surface and an outside surface;

providing a pair of second mating members;

attaching each of said second mating members to said outside surface of said pouch;

providing a pocket being integrated into said pouch having said pocket being positioned within said pouch;

positioning said pouch in said pillowcase having each of said second mating members releasably engaging a respective one of said first mating members to retain said pouch in said pillowcase;

providing an electronic vaporizer having an output wherein said electronic vaporizer is configured to expel an inhalable vapor outwardly through said output;

inserting said electronic vaporizer into said pocket in said pouch;

providing a hose having a first end and a second end;

attaching said first end of said hose to said output of said electronic vaporizer wherein said hose is configured to receive the inhalable vapor;

providing a mouthpiece having a first portion forming an angle with a second portion;

inserting said first portion into said second end of said hose wherein said mouthpiece is configured to receive the inhalable vapor;

pulling said hose outwardly from said pouch thereby exposing said mouthpiece to a user;

sucking on said second portion of said mouthpiece wherein said mouthpiece is configured to deliver the inhalable vapor to the user; and tucking said hose and said mouthpiece into said pouch for storage.

* * * * *